United States Patent [19]

Koskinen

[11] Patent Number: 4,715,635

[45] Date of Patent: Dec. 29, 1987

[54] FLEXIBLE CONTAINER FOR TRANSPORTING AND STORING BULK GOODS

[75] Inventor: Erkki Koskinen, Pori, Finland

[73] Assignee: Oy W. Rosenlew Ab, Finland

[21] Appl. No.: 292,149

[22] Filed: Aug. 12, 1981

[30] Foreign Application Priority Data

Aug. 14, 1980 [FI] Finland ..... 802555

[51] Int. Cl.[4] ..... B65D 29/00; B65D 88/56

[52] U.S. Cl. ..... 294/68.1; 383/121; 383/125

[58] Field of Search ..... 294/64 B, 68, 74; 150/1, 12; 229/54 R, 57, 58, 60, 62, 62.5; 206/806

[56] References Cited

U.S. PATENT DOCUMENTS 3,397,622 8/1968 Goodwin ..... 229/60

4,136,723 1/1979 Skaadel et al. ..... 229/53

*Primary Examiner*—James B. Marbert

*Attorney, Agent, or Firm*—Steinberg & Raskin

[57] ABSTRACT

A flexible container for transporting and storing bulk goods, preferably arranged so as to be liftable by its upper end, is constructed from a tubular blank so as to include a shell, a bottom and a filling aperture, the pleats being formed in the shell having lower parts which are folded so as to be coplanar with the container bottom. In order to both strengthen the relatively weak region of the container bottom and to enable the manufacture of the container in an automated fashion, the tubular container blank is closed by a bottom seam located substantially in the central region of the container bottom and the upper plane of each pleat is folded into the plane of the container bottom and affixed to the lower plane of the respective pleat by a connecting seam. The upper and lower opposed planes of the pleats may be affixed to each other by a seam formed in their respective marginal areas and also may be affixed to each other at substantially central regions thereof by additional connecting seams which are substantially parallel to the seam connecting the lower plane of the pleat to the container bottom.

5 Claims, 5 Drawing Figures

FLEXIBLE CONTAINER FOR TRANSPORTING AND STORING BULK GOODS

BACKGROUND OF THE INVENTION

This invention relates generally to flexible containers for transporting and storing goods and, more particularly, to such flexible containers which are constructed from a tubular blank formed so as to include a shell, a bottom and a filling aperture, the container being liftable by its upper end and wherein pleats are formed in the container shell having lower parts which are folded into the plane of the container bottom.

A first type of flexible transport and storage container for bulk goods is known and is disclosed in Finnish patent application No. 771681 corresponding to U.S. Pat. No. 4,136,723 to Skaadel et al. A container of this type is preferably provided with an inner bag substantially formed of a single piece of tight material having lifting loops in its upper portion and a filling aperture in a central portion. The bottom portion of the container includes at least four flaps provided in respective pairs of equal size flaps and which constitute linear extensions of the container shell, the flaps of each pair being joined at the lower margin so as to form juncture lines which intersect at a single point. Similar bags of this type are also disclosed in CH-patent No. 362,970 and in German Publicizing Print No. 1,126,795. A drawback inherent in large-size bags of this first prior art type is that the bottom of the bag cannot with stand the high stresses to which the central region of the bag bottom is subjected when the bag is filled with bulk goods. This inability to withstand high stresses is due to the fact that the juncture lines provided in the bag bottom intersect at the central point of the bag when the highest peak stresses occur. The peak stresses occur in the central region of the bag bottom as a result of the fact that when filled with bulk goods, the bottom portion of the large-size bag tends to assume a rounded shape.

A second type of prior art flexible container for transporting and storing bulk goods is disclosed in Finnish patent application No. 793,030. In a container of this prior art type, the bottom is constructed of strip-like parts which are joined by connecting seams which are disposed to extend at a substantial distance from the central area of the bag bottom. A container bottom of this type is capable of reliably withstanding all stresses which may be imposed on the container bottom in normal practice since no connecting seams are disposed in the central region of the container bottom which would tend to reduce the strength thereof. This known design for a container bottom may be utilized equally as well in containers provided with lifting loops in their upper portion as well as in containers which are not provided with such lifting loops. Such containers which are not provided with lifting loops, i.e. so-called open bags, are sealed at their filling apertures and may be lifted, for example, utilizing an appropriate lifting hook.

Containers of the second prior art type discussed above have the drawback that the relatively complex structure of the container bottom prevents the manufacture of such containers in an automated fashion or at least makes such automation exceedingly difficult and costly to accomplish. Moreover, several separate manufacturing steps are required to construct containers of this second prior art type, namely, cutting the bottom strips and the affixation of the same. Such drawbacks result in relatively high production costs.

A third type of prior art large-size bag is also known, namely, the so-called pleated large-size bag. In this construction, pleats are formed in the shell of the bag having lower parts which are folded into the plane of the container bottom. In such prior art pleated large-size bags, the pleats are open, whereby the lower side of the pleat is free while the upper side of the pleat becomes taut when stress is applied on the bag. The peak stress is particularly directed on the so-called apex of the pleat, which is constituted by the inside apex point of the large-size bag. Prior art containers of this type have the drawback that the same are frequently ruptured due to the stress conditions arising at the pleat apex, the rupture usually initiating at the pleat apex.

SUMMARY OF THE INVENTION

Accordingly, one object of the present invention is to provide new and improved flexible containers for transporting and storing bulk goods.

Another object of the present invention is to provide a new and improved flexible container which can be constructed from a tubular blank and having a bottom structure which can be manufactured in a simple manner.

Still another object of the present invention is to provide a new and improved flexible container having a bottom structure which in addition to having a simple construction is also sufficiently strong so as to reliably withstand all stresses which may be imposed on the container bottom in actual use.

Briefly, in accordance with the present invention, these and other objects are attained by providing a flexible container constructed of a tubular blank having a free lower margin which is closed by a bottom seam which is located substantially in the central region of the bottom and wherein pleats are formed in the container shell having lower parts which are folded so as to be coplanar with the container bottom and wherein the upper plane of each pleat is folded down into the plane of the container botto and affixed to the lower plane of the pleat.

The opposing upper and lower planes of each pleat are affixed to each other at the lateral edges of the pleat and the strength of the container bottom may be further enhanced by affixing the opposing pleat planes to each other substantially at a central region of the pleats by additional connecting seams.

It is understood that the pleats formed in the shell of the flexible container of the present invention are utilized in order to obtain a bottom structure having high strength by closing the pleats by sewing or otherwise affixing the upper side or plane of the pleat to the lower side or plane of the pleats. A flexible container according to the present invention is significantly more advantageous from a manufacturing standpoint than the flexible containers of the first and second type described above. More particularly, fewer working steps are required in the construction of the flexible container of the present invention since the cutting and affixing operations of the bottom strips necessary in the prior art structures are totally eliminated. Furthermore, the flexible containers of the present invention are eminently suitable for manufacture in an automated manner.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
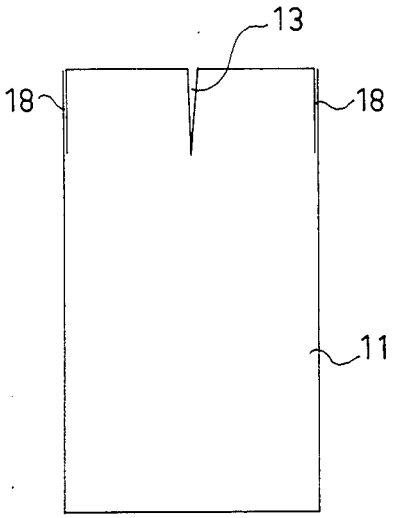
FIG. 1 is a front elevational view of a tubular blank for use in the construction of a container according to the present invention.

Referring now to the drawings wherein like reference characters designate identical or corresponding parts throughout the several views, a flexible container 10 (FIG. 3) is constructed from a tubular blank 11 which is open both at its upper and its lower ends. A cut 13 is formed at the central region of the upper end of the blank 11 for a filling aperture. Moreover, cuts 18 are also provided at the upper end of blank 11 which define strip-like portions 14*a*, 14*b*, 15*a* and 15*b*. The free lower margin of the tubular blank 11 is designated 19 in FIG. 2.

Figure 3:
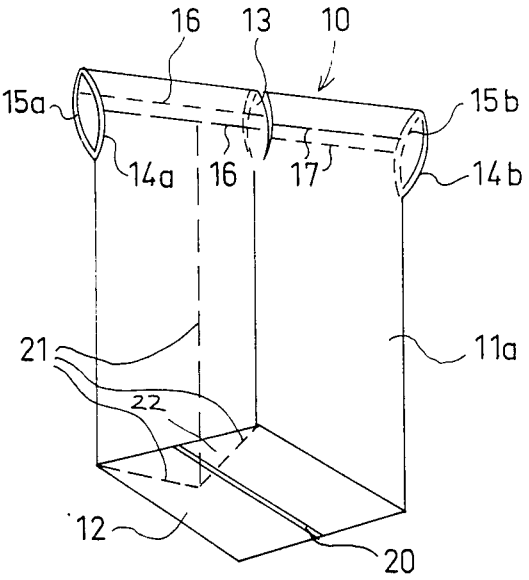
FIG. 3 is a perspective view of a flexible container according to the present invention constructed from the tubular blank illustrated in FIGS. 1 and 2.
Figure 2:
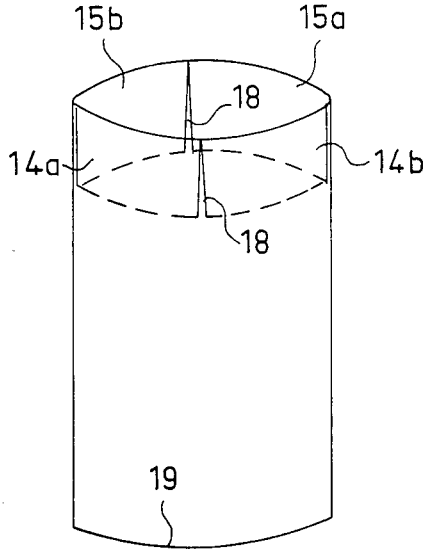
FIG. 2 is a perspective view of the blank illustrated in FIG. 1.

As seen in FIG. 3, a flexible container 10 is constructed from the blank 11 illustrated in FIGS. 1 and 2 and includes a shell 11*a*, a bottom 12, a substantially central filling aperture 13 and lifting loops 14*a*, 14*b* and 15*a*, 15*b*. The container bottom 12 is closed by a connecting seam 20 which is known per se in the art, such seam closing the open free lower margin 19 of blank 11. The blank is formed so that the connecting seam 20 comes to lie substantially in the central region of the bottom 12. As seen in FIG. 3, the flexible container 10 is a so-called pleated container, i.e. two mutually opposed pleats (only one shown) are formed in the shell 11*a*. The pleat is formed as indicated by the dash lines 21, i.e., the lower part of the pleat 21 has been folded so as to be coplanar with the bottom 12 of the container 10.

The lifting loops 14*a*, 14*b* and 15*a*, 15*b* respectively, are advantageously formed in a manner disclosed in Finnish patent application No. 793029 as follows. The strip-like portions 14*a* and 14*b* are folded to overlap and the substantially lower margin of the strip-like portion 14*a* is connected with the substantially upper margin of the strip-like portion 14*b* by a connecting seam 16. The strip-like portions 15*a* and 15*b* are thereafter folded to overlap and the substantially lower margin of the strip-like portion 15*b* is joined to the substantially upper margin of the strip-like portion 15*a* by the connecting seam 17. The connecting seams 16 and 17 are then located on the lifting loops 14*a*, 14*b* and 15*a*, 15*b* respectively, on opposite sides thereof. Of course, it is possible to join the strip-like portions 15*a* and 15*b* so that the substantially lower margin of the strip-like portion 15*a* is joined by the connecting seam 17 to the substantially upper margin of the strip-like portion 15*b*. The connecting seams 16 and 17 will then be located on the same side of the lifting loops.

If desired, it is also possible to join the substantially lower margin of the strip-like portion 14*a* to the substantially lower margin of the strip-like portion 14*b* by a second connecting seam 16 while similarly joining the strip-like portions 15*a* and 15*b* in a like manner. In this case, both lifting loops 14*a*, 14*b*, and 15*a*, 15*b* will have two connecting seams 16 and 17 respectively, located on opposite sides and which lie at a substantial distance from the central region of the lifting loops.

Figure 4:
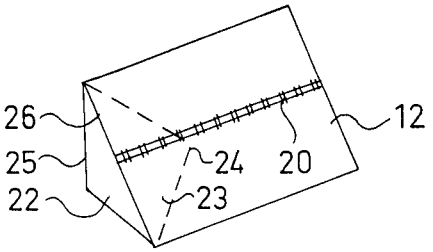
FIG. 4 illustrates the bottom of the flexible container of FIG. 3 viewed obliquely from the underside thereof prior to affixing the opposing planes of the illustrated pleat to each other.

Referring to FIG. 4, the mutually opposed planes of the pleat 21 are indicated by reference numerals 22 and 23 and the apex point of the pleat 21 is designated 24. It is understood that the plane 22 constitutes the upper plane of pleat 21 and correspondingly the plane 23 constitutes the lower plane of the pleat 21. As can be seen in FIG. 4, the margins 25 and 26 of the pleat 21 are separated so that the pleat 21 in this figure constitutes an open pleat.

If the container 10 provided with a bottom 12 as shown in FIG. 4 is stressed, i.e., when the container 10 having a bottom of the type illustrated in FIG. 4 is filled with bulk goods and is lifted, the upper plane 22 of the pleat will be subjected to tension and made taut while the lower plane 23 of the pleat remains free. The peak stress will act particularly at the apex 24 of the pleat 21 which may be characterized as the so-called inner apex point of the container bottom 12. When subjected to loads normally encountered in practice, the bottom 12 of the container 10 having a bottom as illustrated in FIG. 4 will often rupture, the rupture generally being initiated at the apex point 24 of the pleat 21.

Figure 5:
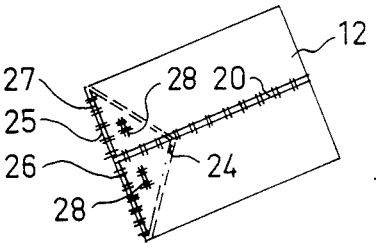
FIG. 5 is a view similar to FIG. 4 illustrating the bottom of the flexible container after the opposing planes of the pleats have been affixed to each other.

According to the present invention, the strength of the container bottom 12 is considerably enhanced by affixing the opposed planes 22 and 23 of the pleat to each other. Thus, by utilizing the pleats 21 already existing in the container 10, significant increases in the strength of the container bottom can be achieved. Referring to FIG. 5, the upper plane 22 of pleat 21 is advantageously affixed to the lower plane 23 thereof by affixing the margin 25 of the upper plane 22 to the margin 26 of the lower plane 23 of the pleat such as by sewing or the like. As illustrated in FIG. 5, a connecting seam of this type is designated 27.

The strength of the bottom 12 of the flexible container 10 of the present invention may be even further enhanced by affixing the opposed planes 22 and 23 of the pleat 21 to each other by one or several additional connecting seams 28. As seen in FIG. 5, two such additional connecting seams 28 are shown which are located substantially in the central region of the pleat 21. The additional connecting seams 28 are preferably substantially parallel to the connecting seam 27. Moreover, in certain cases merely the use of connecting seams 28 will result in an increased strength of the bottom 12 which is sufficient such that the use of a connecting seam 27 on the margin of the pleat 21 is not necessary. The strength of the bottom 12, of course, will be increased to the greatest extent through the simultaneous use of both connecting seams 27 and 28.

The above-described construction of a container 10 according to the present invention results in a substantial reduction in manufacturing costs since only a minimum of manufacturing steps are required due to the fact that there is no cutting or affixation of any bottom strips required. Moreover, the container 10 of the present invention is especially adapted for automated manufacture so that the container 10 can be manufactured, for example, by the aid of three automatic sewing machines. Thus, one automatic sewing machine can sew the bottom seam 20 of the container 10 while the other two machines can provide the connecting seams 27 on both sides of the bottom 12 of the container 10 so as to affix the opposed planes 22 and 23 of the respective pleats 21 to each other. These remarkable advantages of the present invention discussed above are achieved utilizing an exceedingly simple technique, it being understood that the pleats 21 which are utilized in this connection already exist in a completed shape in the container 10.

It is understood that the construction of the upper part of the container 10 forms no part of the present invention. Thus, a particularly advantageous lifting loop design is shown in the embodiment illustrated in FIGS. 1–3, such design being disclosed in Finnish patent application No. 793029. The structure of the container bottom 12 according to the present invention is equally applicable for use on open bags or on large-size bags provided with other types of lifting loops. It should also be noted that the invention is no way limited to the manner in which the pleat 21 is formed. For example, the pleats 21 may also be formed after sewing the bottom seam 20 of the container 10 by forming such pleats in the corners of the bottom seam 20.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A flexible container for transporting and storing bulk goods, said container being constructed from a tubular blank having an open free lower margin and formed so as to include a shell, a bottom and a filling aperture, said container being liftable by its upper end, comprising:

said free open lower margin of the tubular blank being closed by a bottom seam extending substantially over the central region of said container bottom; and substantially longitudinal pleats being formed in said shell, each pleat hving a lower part proximate to said container bottom folded in a manner so as to be coplanar with said container bottom, said lower pleat part including an upper plane and a lower plane, and wherein sid upper plane of each pleat part is folded down into the plane of said container bottom and affixed to said lower plane of said pleat part by a connecting seam.

2. The combination of claim 1 wherein said upper and lower planes of each pleat part include respective margins and wherein said upper and lower planes of each pleat part are affixed to each other by a connecting seam which affixes said margin of the upper plane of the pleat part to the margin of the lower plane of the pleat part.

3. The combination of claim 2 herein said upper and lower planes of each plet part are also affixed to each other at substantially central regions thereof by additional connecting seams in order to enhance the strength of said container bottom.

4. The combination of claim 3 wherein said additional connecting seams are substantially parallel to said connecting seam.

5. The combination of claim 1 wherein said upper and lower planes of each pleat part are affixed to each other at substantial central regions thereof by connecting seams in order to enhance the strength of said container bottom.

* * * * *